US007505705B2

(12) United States Patent
Overall et al.

(10) Patent No.: US 7,505,705 B2
(45) Date of Patent: Mar. 17, 2009

(54) ELECTRICAL DISCHARGING OF IMAGE TRANSFER ASSEMBLIES

(75) Inventors: Gary Scott Overall, Lexington, KY (US); Gregory Lawrence Ream, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 389 days.

(21) Appl. No.: 11/369,151

(22) Filed: Mar. 6, 2006

(65) Prior Publication Data

US 2007/0206969 A1 Sep. 6, 2007

(51) Int. Cl.
*G03G 15/00* (2006.01)

(52) U.S. Cl. ..... 399/90

(58) Field of Classification Search ..... 399/90, 399/115, 116, 117, 159, 174, 175, 176; 361/214, 361/220

See application file for complete search history.

(56) References Cited

U.S. PATENT DOCUMENTS

| | | | | |
|---|---|---|---|---|
| 4,292,386 | A | 9/1981 | Takano | |
| 4,898,487 | A | 2/1990 | Brull et al. | |
| 5,444,523 | A | 8/1995 | Sameshima et al. | |
| 5,537,189 | A * | 7/1996 | Imes | 399/116 |
| 6,364,731 | B1 | 4/2002 | Morita et al. | |
| 6,498,913 | B1 * | 12/2002 | Tooker et al. | 399/90 |
| 6,810,221 | B1 * | 10/2004 | Meyer et al. | 399/90 |
| 6,859,632 | B2 * | 2/2005 | Dougherty | 399/111 |
| 7,035,566 | B2 * | 4/2006 | Aiba | 399/90 |
| 7,062,192 | B2 * | 6/2006 | Oguma et al. | 399/90 |
| 2005/0163526 | A1 | 7/2005 | Kawai et al. | |

FOREIGN PATENT DOCUMENTS

| | | | |
|---|---|---|---|
| JP | 60189774 | A * | 9/1985 |
| JP | 61113079 | A * | 5/1986 |
| JP | 01198767 | A * | 8/1989 |
| JP | 03039756 | A * | 2/1991 |
| JP | 05303984 | A * | 11/1993 |
| JP | 06059534 | A * | 3/1994 |
| JP | 07044059 | A * | 2/1995 |
| JP | 2001228718 | A * | 8/2001 |

* cited by examiner

*Primary Examiner*—Robert Beatty
(74) *Attorney, Agent, or Firm*—Steven J. Grossman

(57) ABSTRACT

The present invention relates to an assembly or method for use with an image forming device. The device may include an image transfer device capable of receiving an extraneous electrostatic charge from a source. A discharge path may then be configured to remove all or a portion of the extraneous electrostatic charge from the image transfer device.

14 Claims, 5 Drawing Sheets

ELECTRICAL DISCHARGING OF IMAGE TRANSFER ASSEMBLIES

TECHNICAL FIELD

This invention relates to discharging extraneous electrical charges and, more particularly, to discharging extraneous electrical charges present on image transfer assemblies.

BACKGROUND

Printing devices often include toner cartridges that affix toner onto paper or other types of media. Typically, the toner cartridges need to be replaced to replenish the toner supply in the printing device. Along with being handled during replacement, the toner cartridges may be adjusted during other time periods (e.g., to fix a paper jam, etc.). By handling a toner cartridge, an electrostatic charge or charges may be transferred to the toner cartridge from the person handling the cartridge. By introducing this extraneous electrostatic charge, printing operations may be affected. For example, dark spots or dark bands may be printed onto the print media based on the electrostatic charge propagating to a printing drum included in the printer cartridge.

SUMMARY OF THE DISCLOSURE

In one exemplary embodiment, the present invention relates to an assembly for an image forming device. The device may include an image transfer device capable of receiving an extraneous electrostatic charge from a source. A discharge path may then be configured to remove all or a portion of the extraneous electrostatic charge from the image transfer device.

In another exemplary embodiment the present invention relates to an assembly for an image forming device. The device may include an image transfer drum comprising a photoconductive outer surface and a conductive inner support structure, wherein the image transfer drum is configured to transfer information to a print media. A discharge path may then be provided and configured to electrically connect the photoconductive outer surface and the conductive inner support structure of the image transfer drum.

In another exemplary embodiment, the present invention relates to a method for electrically discharging an extraneous electrostatic charge. The method may include receiving an extraneous electrostatic charge at an image transfer device from a source. This may then be followed by removing though a discharge path, all or a portion of the extraneous electrostatic charge from the image transfer device.

The details of one or more implementations are set forth in the accompanying drawings and the description below. Other features and advantages will become apparent from the description, the drawings, and the claims.

DETAILED DESCRIPTION

Figure 1:
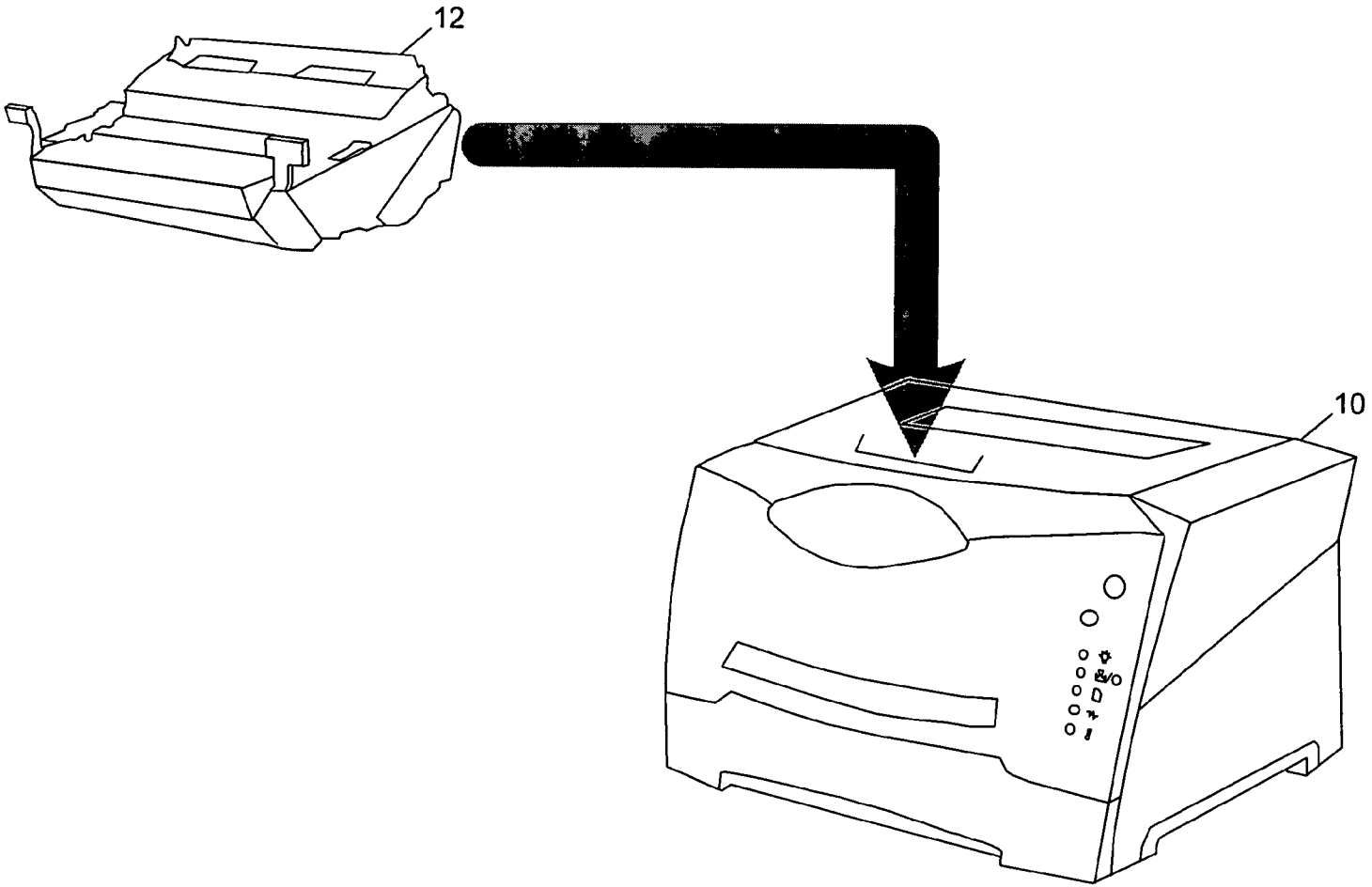
FIG. 1 is a diagrammatic view of an exemplary printing device and an exemplary printer cartridge for use within the printing device.

Referring to FIG. 1, there is shown an exemplary printing device 10 and an exemplary printer cartridge 12 for use within printing device 10. Printing device 10 may be coupled to a computing device (not shown) via e.g. a parallel printer cable (not shown), a universal serial bus cable (not shown), a network cable (not shown), and/or a wireless link (not shown). Image forming devices herein may include, e.g., electrophotographic printers, ink-jet printers, dye sublimation printers, thermal wax printers, electrophotographic copiers, electrophotographic multi-function devices, electrophotographic fascimile machines, or other types of image forming devices.

Exemplary printing device 10 may be a device that accepts text and graphic information from a computing device and may transfer the information to various forms of media (e.g., paper, cardstock, transparency sheets, etc.). Further, printer cartridge 12 may be a component of exemplary printing device 10, which typically includes the consumables/wear components (e.g. a toner delivery assembly, etc.). Additionally, printer cartridge 12 may use various types of image-forming substances (e.g., toner, ink, dye, wax, etc.) for transferring textual and graphical information. Printer cartridge 12 typically also includes circuitry and electronics (not shown) for connection to components (e.g., a photoconductor drum, etc), for setting component voltages, and to control the operation of printer cartridge 12 (e.g. via an attached memory device).

Figure 2:
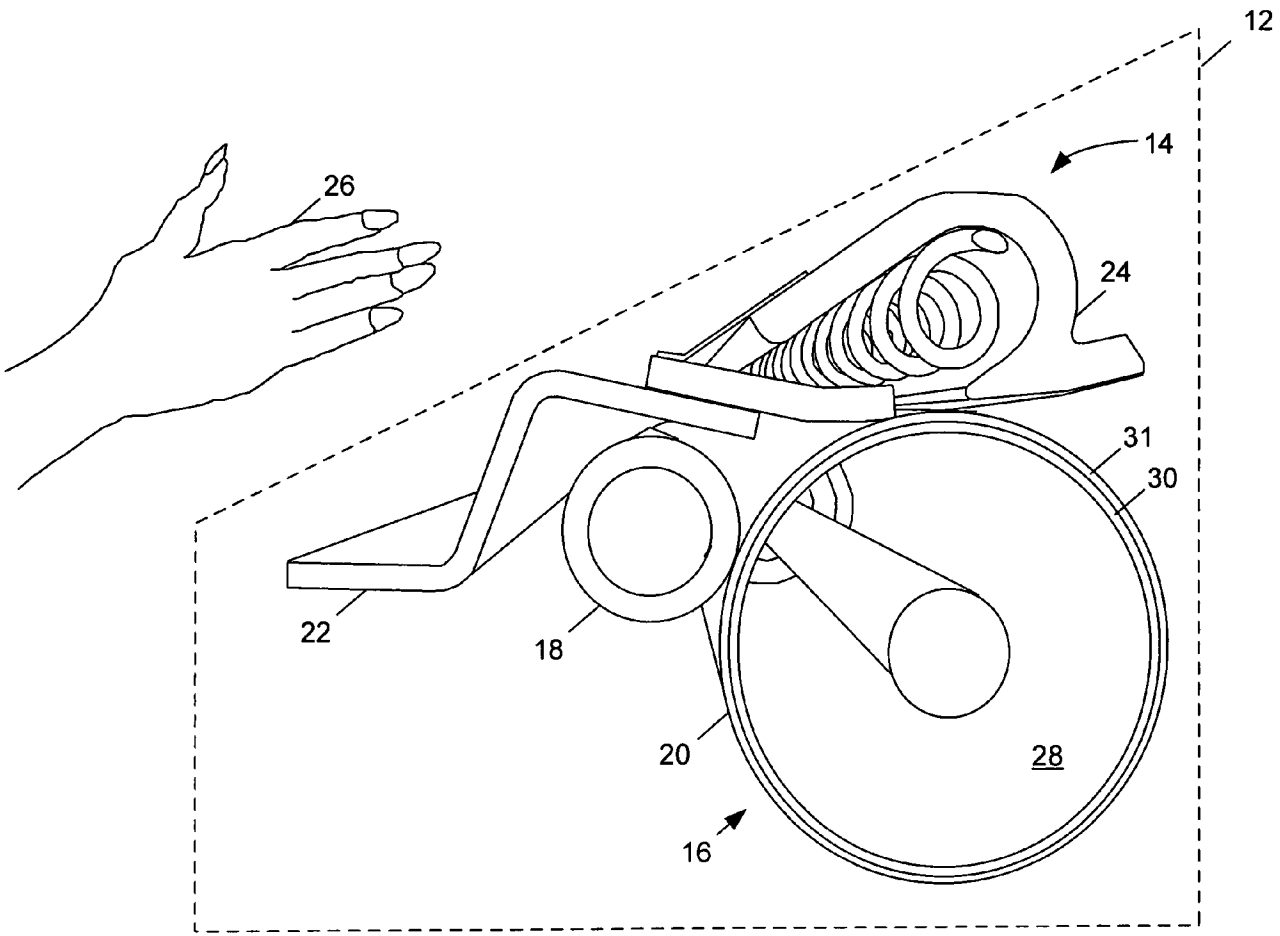
FIG. 2 is a diagrammatic view of an extraneous electrostatic charge being introduced to an image transfer assembly included in the printer cartridge shown in FIG. 1.

Referring also to FIG. 2, there is shown an exploded view of an image transfer assembly 14 that may be included in printer cartridge 12. In this exemplary design, image transfer assembly 14 may use toner to produce images on a printable media. However, in some implementations, image transfer assembly 14 may utilize other image-producing substances (e.g., ink, dye, wax, etc.) individually or in combination with toner.

Image transfer assembly 14 may include a photoconductor drum 16 that may be partially electrically charged and may subsequently be exposed to light to create a latent, electrostatic image to attract toner. In a charged-area-development (CAD) system, toner is attracted to portions of the drum left charged. In a discharged-area-development (DAD) system, toner is attracted to discharged portions of the drum. However, in some embodiments, image transfer assembly 14 may include other types of image transfer devices that transfer an image to a print media. For example, other photoconductive image transfer devices (e.g., a photoconductive belt, a photoconductive panel, a photoconductive surface, etc.) or any other type of transfer device (e.g., ink jet, etc.) may be implemented.

Once present on photoconductor 16, the toner may be transferred to a print media such as paper. To attract toner, an electrical charge may be provided to photoconductor drum 16 by a charge roller 18 that may be in electrical contact with a portion of an outer surface 20 of photoconductor drum 16. A power source (not shown) may be electrically connected to charge roller 18 via an electrically conductive bracket 22 to provide an electrical charge. Typically the power supply may be located within printing device 10.

Bracket 22 may also provide a handling surface for a user to e.g., adjust, remove, and/or insert printer cartridge 12 within printing device 10. While FIG. 2 presents bracket 22 with one particular size and shape, various shapes and types of handling surfaces may be implemented.

As photoconductor drum 16 rotates e.g., counterclockwise outer surface 20 of the photoconductor drum is first charged by charge roll 18. Subsequently, the photoconductor drum is exposed to a light source such as a laser or other pattern-forming device (not shown). Patterns (e.g., that may correspond to text, graphics, etc.) may be formed as latent electrostatic images on the photoconductor surface. As the photoconductor drum continues to rotate, toner is then developed onto the latent electrostatic image from a developer unit (not shown), creating visible, toned images on the drum surface. As previously mentioned, toner is developed into discharged areas in a DAD system and into charged areas in a CAD system. The patterns may then be applied to print media (e.g., paper, transparency sheet, etc.) from photoconductor drum 16 at a transfer station (not shown). Alternatively, the patterns may first be transferred from photoconductor drum 16 to an intermediate transfer member (ITM) (not shown) and subsequently from the ITM to the print media. Image transfer assembly 14 may also include an Auger and Cleaner Blade Assembly 24 that may remove and collect excess toner that may remain after transferring the toned image onto the print media.

As mentioned, for adjusting, inserting, and/or removing printer cartridge 12, e.g., a user 26 may grasp bracket 22. However, electrostatic charge present on user 26 may be transferred to electrically conducting bracket 22. Correspondingly, the electrostatic charge may be transferred from bracket 22, to charge roller 18, and to a portion of outer surface 20 of photoconductor drum 16.

Photoconductor drum 16 may include an electrically conductive inner support structure 28. In this embodiment, conductive inner support structure 28 may be a cylinder of metallic material (e.g., aluminum). However, in other embodiments, inner support structure 28 may implement other types of support structures (e.g. a metallic belt or plate). Additionally, support structure 28 may be anodized in the case of aluminum or coated with a thin, semi-conductive barrier layer. Sandwiched between the conductive inner structure 28 and outer surface 20 may be a substantially non-conductive layer 30. A charge generation layer (CGL) 30 may operate to substantially isolate conductive inner structure 28 from outer surface 20. Additionally, CGL layer 30 may serve to generate positive and negative charges when exposed to light. A charge transport layer (CTL) 31 may be normally insulating, but may be capable of transporting either positive or negative charges that are produced when the CGL is exposed to light.

For instance, for a negative-charging photoconductor, the surface of the photoconductor is charged to a negative potential and positive charge generated at CGL layer 31 may be electrostatically attracted to and transported as "holes" from the CGL layer through CTL layer 31 to outer surface 20 where a portion of the negative charge is neutralized. If positive charge is deposited on the outer surface of an otherwise uncharged photoconductor, a portion of the positive charge may be transported through CTL layer 31 to CGL layer 30 of the photoconductor. When the photoconductor drum 16 is not exposed to light, due to the non-conductive properties of CTL layer 31 and CGL layer 30, charge may be present on both outer surface 20 and conductive inner support structure 28, thereby producing a capacitive effect.

When an extraneous electrostatic charge is introduced to outer surface 20 of photoconductor drum 16, due to the capacitive effects caused by 20 and 30, charge may become trapped on outer surface 20. This trapped charge may be present for a relatively short (e.g., minutes) or long (e.g., days) period of time. When photoconductor drum 16 may be operating (i.e., transferring toner to print media), the trapped charge may substantially affect (e.g., neutralize) some of the charge applied by charge roller 18, or the trapped charge may affect the efficiency of outer surface 20 and layer 30. For example, additional charged toner may be attracted to outer surface 20. This additional toner may produce undesired marks (e.g., spots, lines, etc.) on the print media passed through printing device 10. Along with user contact, extraneous electrostatic charge may be introduced by one or more other sources. Friction may produce extraneous electrostatic charge that may be introduced to outer surface 20 via triboelectric charging. For example, packing material and/or components of printer cartridge 12 (and/or printing device 10) may produce extraneous electrostatic charges of either negative or positive polarity as a result of frictional contact.

To isolate outer surface 20 from extraneous charges, some conventional printing devices may include one or more coverings or protective housings. However, smaller printer designs and material costs render these isolation techniques undesirable.

Figure 3:
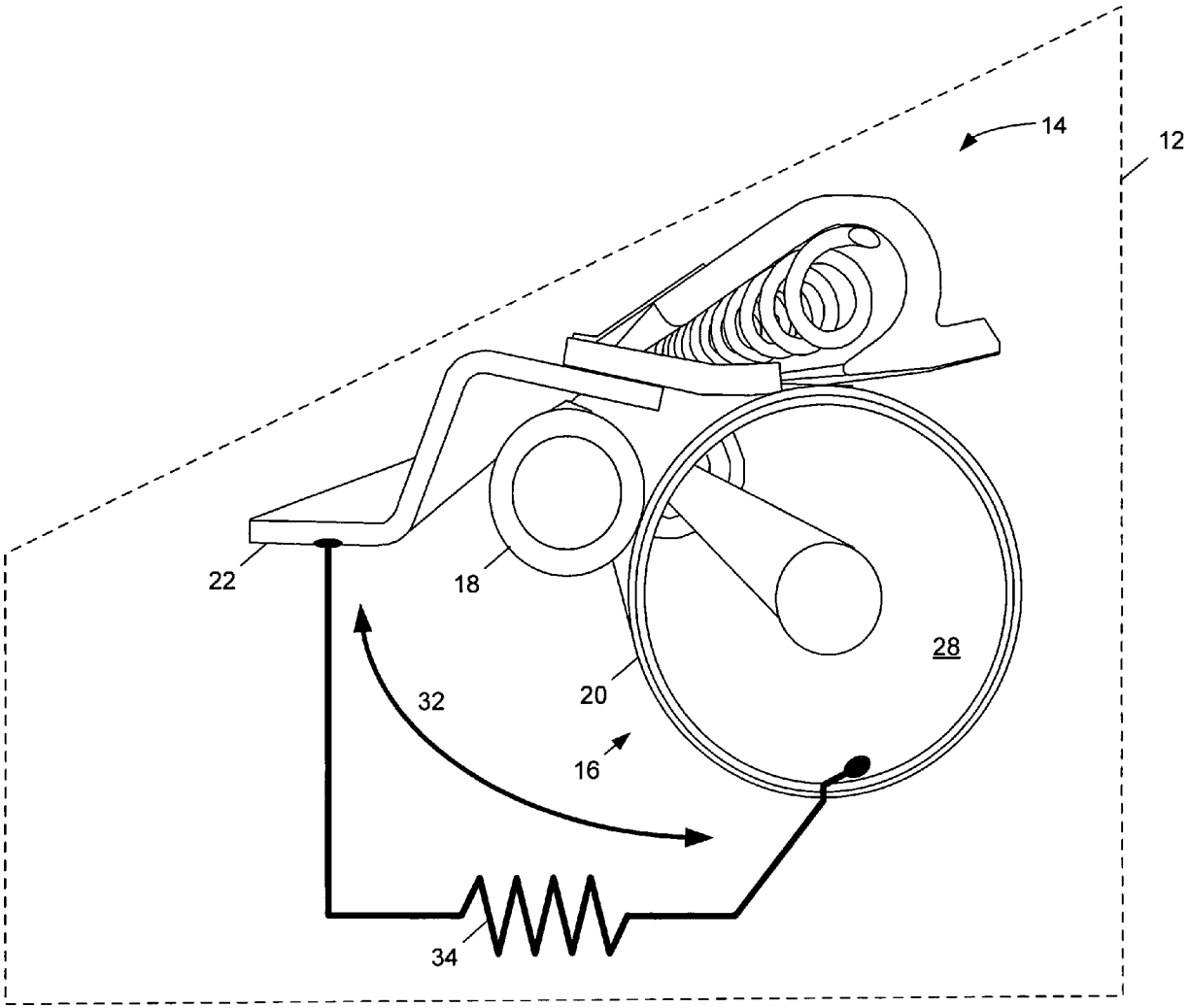
FIG. 3 is a diagrammatic view of a path for discharging the extraneous electrostatic charge introduced in FIG. 2.

Accordingly, FIG. 3 presents a discharge path 32 that may be incorporated into image transfer assembly 14. The discharge path may be configured so that it may be removable. For example, it may be removed by a user prior to operation or installation of the image transfer assembly. By electrically connecting conductive bracket 22 to the electrically conductive inner support structure 28, extraneous charges introduced to the bracket may be substantially discharged. For example, by incorporating discharge path 32, voltage present on bracket 22 may become substantially equivalent to the voltage present on inner support structure 28. Since bracket 22 may be electrically connected to outer surface 20 (via charge roller 18), the voltage present on outer surface 20 may become substantially equivalent to the voltage present on inner support structure 28. By placing these surfaces (i.e., outer surface 20 and conductive inner support structure 28) at substantially equivalent potentials, extraneous charges may be substantially discharged. Accordingly, un-needed additional toner may not be attracted to outer surface 20. Additionally, extraneous charge directly introduced to outer surface 20 (e.g., user 26 directly touches outer surface 20) may be discharged through discharge path 32 via the electrical connection that may be formed between from outer surface 20, charge roller 18, bracket 22, and inner support structure 28.

By discharging the extraneous charge, between 1% and 100% (and any increment or value therebetween) of the extraneous charge may be removed. Preferably, the extraneous charge may be substantially removed so that, e.g., dark spots or dark bonds are reduced. Accordingly, more than about 50% of the extraneous electrostatic charge may be removed, including all values above 50%, e.g., greater than 60%, greater than 70%, etc., up to about 100%.

When printing device 10 is not in operation, typically minimal charges may be applied by charge roller 18 to outer surface 20. These minimal charges are substantially discharged by discharge path 32 during these inactive periods. However, during operating periods, charge roller 18 may actively introduce charge such that a voltage difference may be present between outer surface 20 and inner support structure 28. For example, portions of outer surface 20 may be actively charged by charge roller 18 to approximately −800 volts by application of −1300 volts to the charge roll (e.g., for a direct current (DC) charging system) or −800 volts DC and 2000 volts peak-to-peak (e.g., for an alternating current charging system). Since a voltage difference may be needed for printing operations, discharge path 32 may also allow charging of outer surface 20 without substantially loading the charging system (e.g., a power supply (not shown)). Thus, discharge path 32 may provide a conductive path for discharging extraneous charges while not substantially overloading the power supply (e.g., produce a short circuit) that supplies power to charge roller 18 during operational periods.

Accordingly, for this capability, discharge path 32 may include a resistive element 34 that may provide a relatively large resistance. By incorporating this resistance, current flow through discharge path 32 during printing periods may be relatively small compared to current that may be provided (by a power supply) to charge roller 18 for charging portions of outer surface 20. For example, 20 micro amperes (μA) may be drawn by charge roller 18 to charge portions of outer surface 20 in preparation for printing. To not substantially overload the power supply, current flowing through discharge path 32 may be preferably less than 20 μA. So, if outer surface 20 may be charged to e.g. −1300 volts and resistive element 34 has a resistance of 100 Mega-Ohm ($100\times10^6$ Ohm), current flowing through discharge path 32 may be approximately 13 μA (−1300 volt/$100\times10^6$ Ohm). Preferably, resistive element 34 may have a larger resistance, e.g., 5 Giga-Ohm ($5\times10^9$ Ohm). Using this resistance, the current flowing through discharge path 32 may be approximately 0.26 μA (−1300 volt/$5\times10^9$ Ohm). Thus, by comparison, relatively large resistances may reduce current flow through resistive element 34 so as not substantially overload the power supply providing the 20 μA DC current to charge roller 18.

Along with reducing power supply loading, discharging time may also factor into selecting the resistance of resistive element 34. In some scenarios a discharge time between 0.1 and 10 seconds (and no more than 100 seconds) may be desirable. To account for discharge time, the capacitance between inner support structure 28 and outer surface 20 may be determined. For example, the capacitance per unit area between inner support structure 28 and the outer surface 20 may be approximately 100 pico-Farad (pF)/cm$^2$. For a contact area of approximately 1 mm×200 mm, the capacitive load may be approximately 200 pF. Using the time constant relationship T=RC (where R is the resistance of resistive element 34 and C is capacitance between outer surface 20 and inner support structure 28), the resistance to provide a 10 second time constant may be determined:

$$R=T/C=10 \text{ seconds}/200\ pF=50 \text{ Giga-Ohm } (5\times10^{10} \text{ Ohm}).$$

Similarly, the resistance for a 1 second time constant may be determined:

$$R=T/C=1 \text{ second}/200\ pF=5 \text{ Giga-Ohm } (5\times10^{9} \text{ Ohm}).$$

Still further, the resistance for a 0.1 second time constant may be determined:

$$R=T/C=0.1 \text{ seconds}/200\ pF=500 \text{ Mega-Ohm } (5\times10^{8} \text{ Ohm}).$$

So, for some embodiments, to provide an appropriate discharge time without excessive power supply loading, a resistance may be selected within a range of approximately 100 Mega-Ohm to approximately 10 Giga-Ohm.

Various types of resistive elements may be used to implement resistive element 34. For example, discrete electronic components such as one or more resistors or other types of components (e.g., diodes, transistors, etc.) may be implemented to provide the resistance. Various types of resistive materials may also be used. For example, resistive tape, resistive film, semi-conductive plastic, resistive coating (e.g., paint), or other similar material may be used individually or in combination.

In some arrangements, photo-sensitive material may be incorporated into resistive element 34. By using this material, when resistive element 34 is substantially exposed to light, the resistance of the element decreases. For example, when printing device 10 is opened to allow access to internal components (such as printer cartridge 12), the resistance of resistive element 34 may decrease to provide an appropriate discharge path for extraneous charges introduced to bracket 22 and/or outer surface 20. Then, when the housing of printing device 10 is closed to resume printing operations, the light incident upon resistive element 34 may be reduced. Correspondingly the resistance of resistive element 34 may increase such that charge roller 18 may apply a charge to outer surface 20 without substantially overloading a power supply being used by the charge roller.

Switching techniques may also be implemented to introduce resistive element 34 into discharge path 32 during appropriate time periods. For example, discharge path 32 may include a mechanical switch that completes discharge path 32 when the housing of printing device 10 may be opened. By completing discharge path 32, extraneous charge (e.g., introduced by a user) may be substantially discharged as previously described. Alternatively, when the housing of printing device 10 is closed, the switch may electrically open discharge path 32. Along with incorporating one or more switches in discharge path 32, in some implementations discharge path 32 may include one or more resistive elements or multiple networks of resistive elements.

To provide switching functionality, various types of switches may be implemented. For example, one or more mechanical switches and/or electrical switches may be incorporated into discharge path 32. Switching may also be provided by one or more electronic components (e.g., diodes, transistors, relays, etc.) that may be configured individually or in combination to function as one or more switches.

Figure 4:
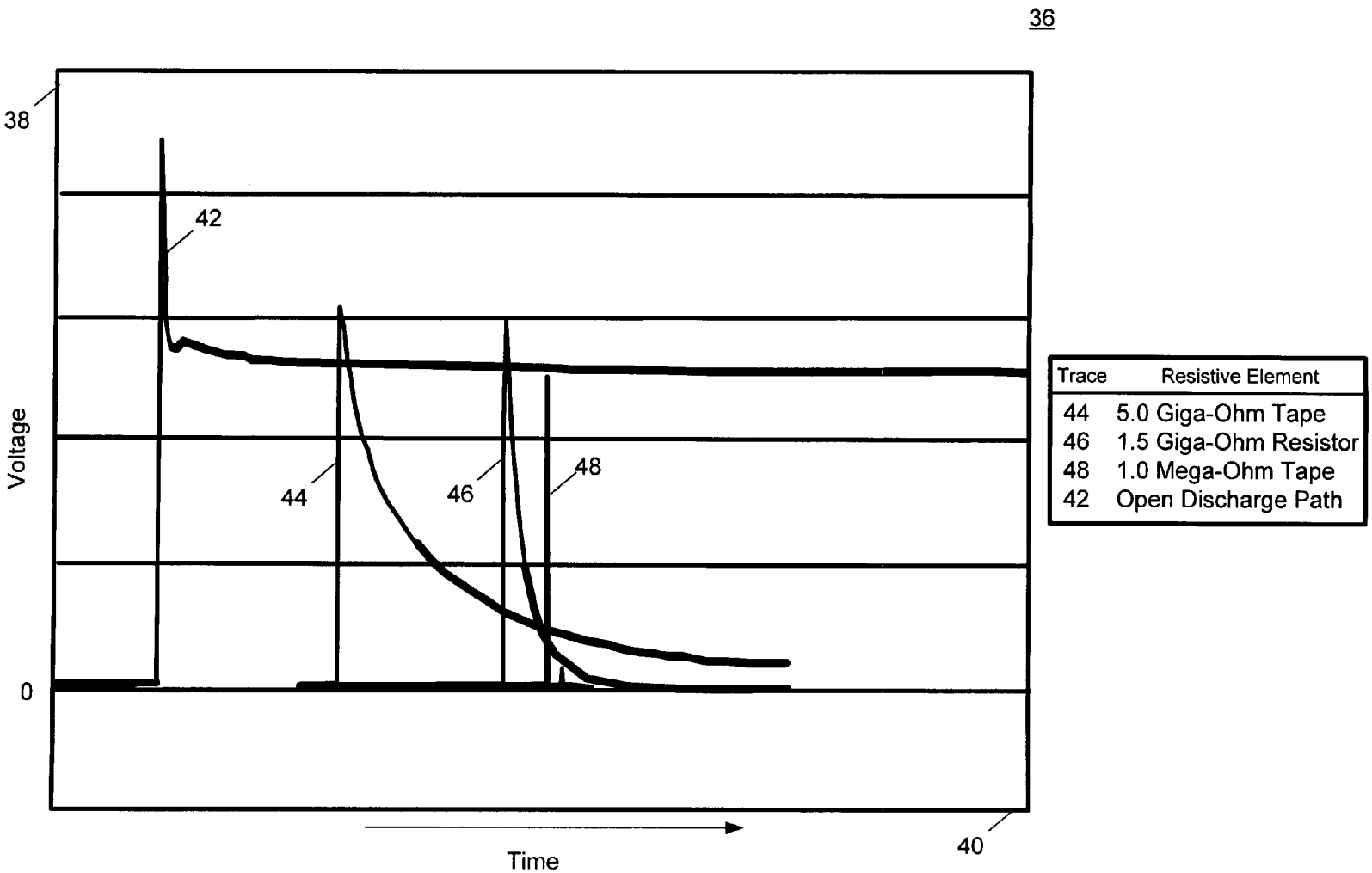
FIG. 4 is a chart that represents discharge performance provided by resistive elements included in the discharge path shown in FIG. 3.

Referring also to FIG. 4, a chart 36 represents discharging that may be provided by four exemplary resistive elements incorporated into discharge path 32. For each case, voltage is represented on y-axis 38 versus time on x-axis 40. Each data trace on chart 36 represents the voltage present on bracket 22 as a +3000 volts charge may be introduced (e.g., by a user) onto the bracket. Trace 42 represents a scenario when discharge path 32 may be an open circuit (i.e., infinite resistance). As time increases, trace 42 includes a sharp spike that may represent the initial appearance of the +3000 volts charge. As time continues, voltage decreases to a substantially constant non-zero value. Thereby, absent a discharge path, charge may become trapped on outer surface 20 (via bracket 22 and charge roller 18). Traces 44, 46 and 48 respectively may represent the voltage present on bracket 22 when three different types of resistive elements are included in discharge path 32. Each of these traces may be slightly shifted in time for ease of viewing. Trace 44 represents when a 5.0 Giga-Ohm ($5\times10^9$ Ohm) resistive tape may be incorporated into discharge path 32, trace 46 may represents when a 1.5 Giga-Ohm ($1.5\times10^9$ Ohm) discrete resistor may be present, and trace 48 represents when a 1.0 Mega-Ohm ($1\times10^6$ Ohm) resistive tape may be present. As shown by each respective trace, after an initial spike, the voltage level may reduce and approach 0 volt. Additionally, due to the individual resistances, the discharge time may be controlled. For example, the discharge time represented by trace 44 may be longer than the discharge time represented by trace 46 (which may be longer than the discharge time represented by trace 48). Thus, in this example, as the resistance of the resistive element decreases, discharge time may correspondingly decreases.

Figure 5:
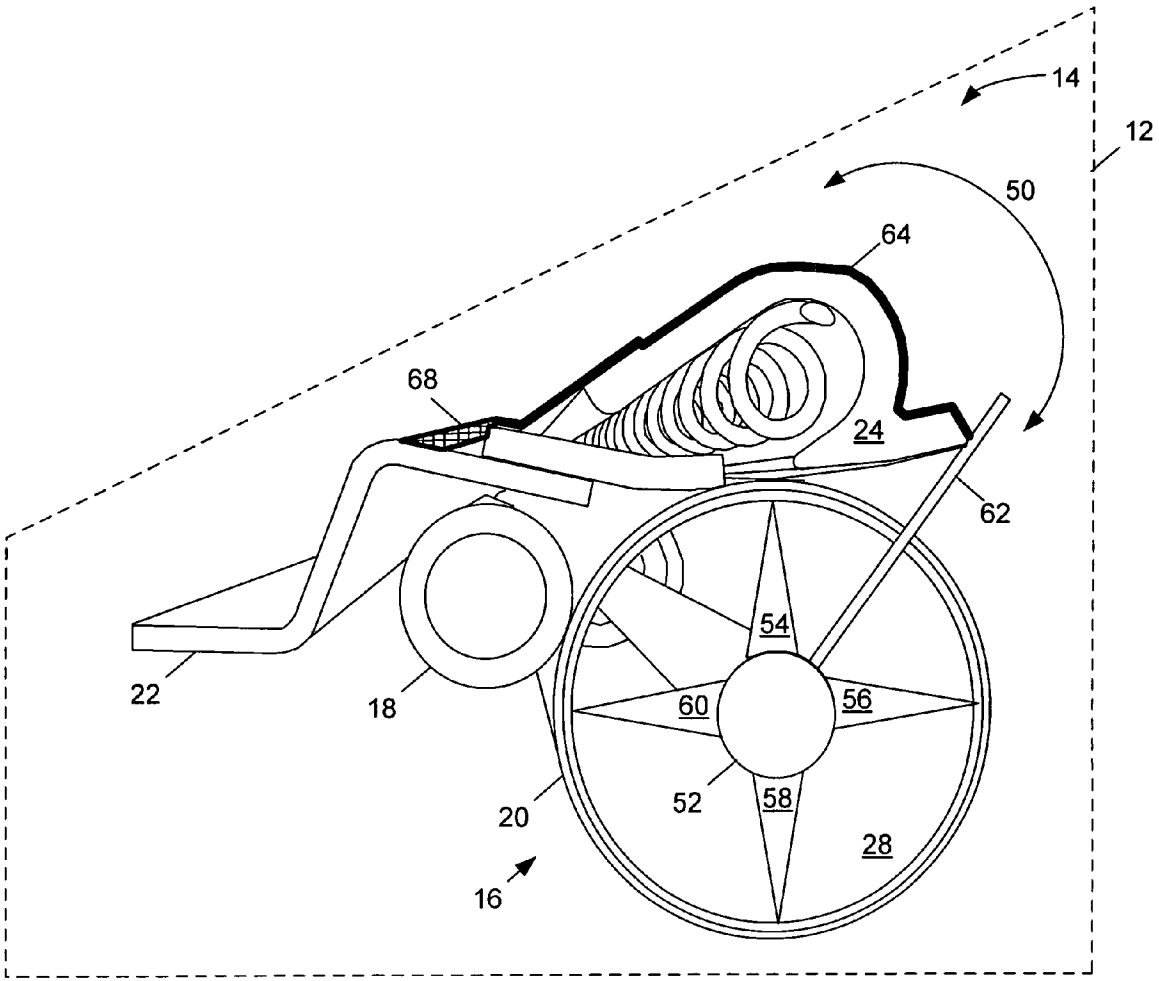
FIG. 5 is a diagrammatic view of an exemplary discharge path that includes one type of resistive element.

Referring to FIG. 5, an exemplary discharge path 50 may be incorporated into image transfer assembly 14. Similar to discharge path 32, discharge path 50 may electrically connect conductive bracket 22 to inner support structure 28. Starting from inner support structure 28, discharge path 50 may include a disk 52 of conductive material (e.g., metal) that may include e.g., four electrically conductive appendages 54, 56, 58 and 60. Conductive appendages 54, 56, 58 and 60 may be electrically connected to four locations along the inner circumference of inner support structure 28. A rod-shaped electrical conductor 62 may be electrically connected to a portion of disk 52 and may extend from the disk to an edge of auger and cleaner blade assembly 24. In this implementation, an electrically conductive tape 64 may be applied to an outer surface of auger and cleaner blade assembly 24 and may be in electrical contact with electrical conducting rod 62. Electrically conductive tape 64 may extend over the outer surface of auger and cleaner blade assembly 24 towards electrical conducting bracket 22. To complete discharge path 50 and provide a resistive element, a resistive tape 68 may connect conductive bracket 22 to conductive tape 64. By incorporating different types, widths, and lengths of resistive tape, the resistance in discharge path 50 may be selected such that extraneous charge may be discharged (in a desirable time period) without overloading a power supply used to charge photoconductive drum 16 via charge roller 18.

While discharge path 50 may implement resistive tape 68 to provide a resistive element, one or more other types of resistive elements may be incorporated into the discharge path. For example a discrete resistor may be implemented individually or in combination with resistive tape 68.

A number of implementations have been described. Nevertheless, it will be understood that various modifications may be made. Accordingly, other implementations are within the scope of the following claims.

What is claimed is:

1. An assembly for an image forming device comprising:

an image transfer drum comprising a conductive outer surface and a conductive inner support structure, wherein the image transfer drum is configured to transfer information to a print media; and a discharge path configured to electrically connect the conductive outer surface and the conductive inner support structure of the image transfer drum, wherein the discharge path includes a resistive element, wherein the resistive element includes a resistive tape.

2. The assembly of claim 1, further comprising:

a component capable of passing an extraneous electrostatic charge from a user to the image transfer drum.

3. The assembly of claim 2, wherein the component includes a conductive handling surface.

4. The assembly of claim 1, further comprising:

a switch capable of electrically opening the discharge path.

5. The assembly of claim 4, wherein the switch includes a mechanical switch located in the image forming device.

6. The assembly of claim 1 located within a printer cartridge.

7. An assembly for an image forming device, comprising:

an image transfer device selected capable of receiving an extraneous electrostatic charge from a source;

a discharge path configured to remove all or a portion of the extraneous electrostatic charge from the image transfer device, wherein the discharge path includes a resistive element with a resistance of at least 100 Mega-Ohm; and a component capable of passing the extraneous electrostatic charge from a user to the image transfer device.

8. The assembly of claim 7, wherein the resistive element has a resistance of less than 10 Giga-Ohm.

9. The assembly of claim 7 located within said image forming device.

10. The assembly of claim 7 located within a printer cartridge.

11. The assembly of claim 7, wherein the component includes a handling surface.

12. An assembly for an image forming device, comprising:

an image transfer device capable of receiving an extraneous electrostatic charge from a source wherein the image transfer device is selected from the group consisting of a photoconductive device and an image transfer drum; and a discharge path configured to remove all or a portion of the extraneous electrostatic charge from the image transfer device, wherein the discharge path includes a resistive element with a resistance of at least 100 Mega-Ohm.

13. An assembly for an image forming device, comprising:

an image transfer device capable of receiving an extraneous electrostatic charge from a source; and a discharge path configured to remove all or a portion of the extraneous electrostatic charge from the image transfer device, wherein the discharge path includes a resistive element with a resistance of at least 100 Mega-Ohm wherein the resistive element is selected from a group consisting of a resistive tape, a semi-conductive plastic, a photoconductive material, and a resistive coating.

14. An assembly for an image forming device, comprising:

an image transfer device capable of receiving an extraneous electrostatic charge from a source; and a discharge path configured to remove all or a portion of the extraneous electrostatic charge from the image transfer device, wherein the discharge path includes a resistive element with a resistance of at least 100 Mega-Ohm; and a switch capable of electrically opening the discharge path.

* * * * *